United States Patent [19]

Hennessy

[11] Patent Number: 4,707,868

[45] Date of Patent: Nov. 24, 1987

[54] TOILET FLUSHING APPARATUS

[75] Inventor: Arnold Hennessy, Wellington, Canada

[73] Assignee: AHED Research and Development Inc., Ingleside, Canada

[21] Appl. No.: 866,619

[22] Filed: May 27, 1986

[30] Foreign Application Priority Data

Jun. 13, 1985 [CA] Canada ..... 483942

[51] Int. Cl.[4] ..... E03D 3/10

[52] U.S. Cl. ..... 4/362; 4/354; 4/361; 4/415; 4/380

[58] Field of Search ..... 4/380, 300, 354, 361, 4/362, 437, 335, 425, 429, 421, 415, 321, 323, 317, 437, 434, 331

[56] References Cited

U.S. PATENT DOCUMENTS

| | | | |
|---|---|---|---|
| 1,106,285 | 8/1914 | Darrow | 4/354 X |
| 1,465,823 | 8/1923 | Hobeck et al. | 4/361 X |
| 1,793,446 | 2/1931 | Oscanyan | 4/362 |
| 2,886,826 | 5/1959 | Shaleen | 4/354 X |
| 3,588,923 | 6/1971 | Haglund et al. | 4/362 |
| 3,813,701 | 6/1974 | Steven | 4/362 |
| 4,060,857 | 12/1977 | Couton | 4/362 |
| 4,310,934 | 1/1982 | Hennessy | 4/354 |

*Primary Examiner*—Henry K. Artis

*Attorney, Agent, or Firm*—D. Ron Morrison

[57] ABSTRACT

A diaphragm valve for a toilet flushing mechanism, and a hydraulic flushing assembly using the valve, control water mains pressure for the pressure flushing of toilets with small quantities of water. Water mains pressure is used to retain a flexible diaphragm against the orifice through which flushing water from a pressurized tank can flow through the valve when flushing action is desired; flushing is initiated by temporarily lowering the water pressure applied to retain the diaphragm. Various designs of pressurized tank can be used to provide a constant or variable volume flush, which can be less than six quarts or liters.

10 Claims, 6 Drawing Figures

Figure 1:
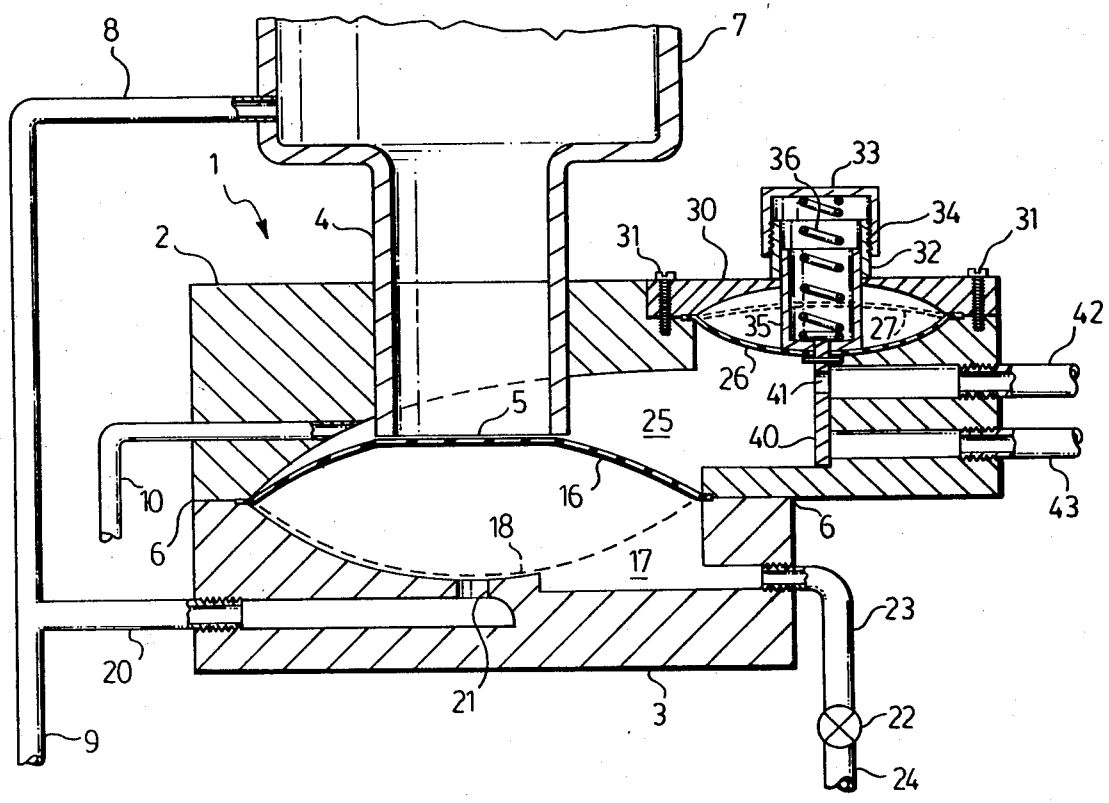

FIG. 2.
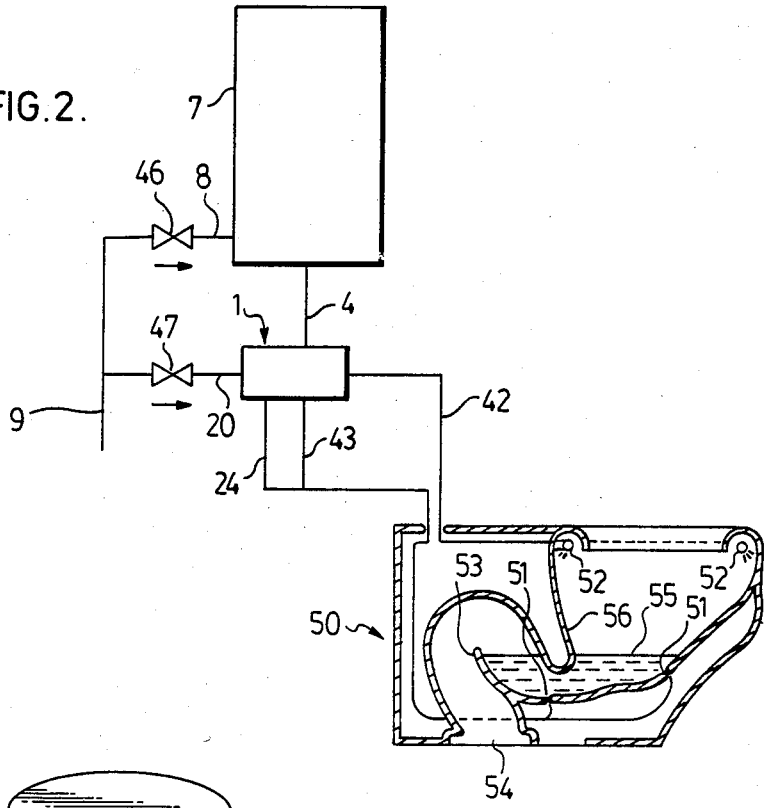
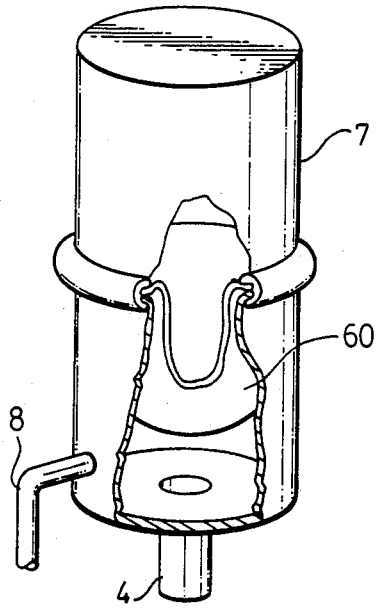
FIG. 3.

TOILET FLUSHING APPARATUS

This invention is directed to a valve and an assembly for flushing a toilet and similar devices requiring pressure flush. More particularly, it is directed to a valve mechanism which provides a flush water stream at sufficient pressure to ensure that the bowl is properly evacuated of waste materials with a small quantity of water used per flush.

Conventional toilet flushing mechanism use the siphon action of a volume of water passing through a trap and down a waste pipe to cause evacuation of the waste in the bowl. A large volume of water is normally required to initiate the siphon with the result that a conventional toilet uses from 20 to 25 liters of water per flush. In a world of decreasing fresh water supplies, such profligate use of water is improvident. Recognizing this problem, many researchers have attempted to develop toilets requiring less water per flush.

It is known that pressure flush toilet bowls can force the bowl water and waste up and through the trap by directing a jet towards the trap, thus moving the water out of the bowl without the need to develop a siphon. A conventional method of accomplishing this in large buildings is to provide large diameter pipes and timer valves to the toilets. In homes, however, the typical 12 mm diameter water pipes will not provide a sufficient flow rate to flush properly with such mechanisms, and various means of holding and delivering the inventory of water under pressure have been devised. In U.S. Pat. No. 2,957,181, a piston was employed to actuate a flush valve, which was maintained in the open position by a tension spring until it was pushed into the closed position by the main pressure piston in the reservoir. In U.S. Pat. No. 3,667,294, water held in a pressure tank was controlled by a multi-ported slide valve and piston valve. Canadian Pat. No. 1,094,255 disclosed a vacuum flush water closet having a diaphragm-operated flush valve, the diaphragm being held in place by a spring. West German OS No. 2,116,991 disclosed a toilet flush with a pressure chamber and a spring loaded diaphragm valve with a pressure release flush valve. U.S. Pat. No. 4,310,934 showed an air diaphragm-operated flush valve which is closed by the gradual bleeding of air away from the diaphragm.

The present invention provides a diaphragm valve which operates by premediated variation of water main pressure thereon, and a hydraulic flushing assembly incorporating said valve. The invention thus consists in a diaphragm valve for an hydraulic flushing mechanism, said valve comprising:

(1) a first body portion, fastened to (2) a second body portion, (3) a flexible diaphragm between the body portions which also separates, into two separate chambers, an enclosure formed by the two body portions, (4) a discharge orifice from an adjacent tank of water maintained under pressure, said orifice protruding into the first of said chambers through said first body portion, having a discharge area smaller than the area of the first side of said diaphragm, and being adapted to be sealed by the diaphragm in a sealing position, (5) inlet means through the second body portion, connected to a water supply at water main pressure, to supply water to the second of said chambers through a constricted aperture, the diaphragm being adapted to maintain its sealing position by water at water main pressure on the second side of the diaphragm in the second chamber, (6) a release valve adapted to release water pressure in the second chamber and discharge same to atmospheric pressure through a discharge line, and (7) at least two outlets from said first chamber to discharge water from the chamber, one of said outlets being adapted to communicate directly to a pressure flush toilet facility and another to an atmospheric pressure discharge.

In one particular embodiment of the valve of the invention, there are three outlets from the first chamber of the valve, with the first being continuously open to discharge at atmospheric pressure and the other two being connected to discharge through pressure flush and rinse lines of a pressure flush toilet facility respectively. In an optional modification of this embodiment, a control valve, responsive to variation of water pressure in the first chamber, is used to regulate discharge alternately between the aforesaid pressure flush and rinse lines.

The invention further consists in a hydraulic flushing assembly comprising:

(1) a tank adapted to receive and maintain a quantity of water under pressure, (2) a water supply at mains pressure to said tank, (3) an outlet conduit from said tank terminating in a discharge orifice, (4) a diaphragm valve for an hydraulic flushing mechanism, as defined hereinabove, mounted on said discharge orifice, (5) a first discharge line communicating between one outlet from the first chamber of said diaphragm valve and the jets of a pressure flush toilet facility, (6) a second discharge line communicating between a second outlet from said first chamber and the rinse piping of said toilet, (7) a third discharge line communicating between a third outlet from said first chamber and a discharge point open to the atmosphere and above the highest water level in the toilet. Optionally and preferably said third discharge line discharges into a surge resevoir which drains by gravity into said toilet. Also optionally and preferably, the discharge line from the second chamber of the diaphragm valve likewise discharges into said surge resevoir on operation of the release valve associated with the diaphragm valve. In a particular embodiment of the hydraulic flushing assembly, communication from the first chamber of the diaphragm valve to the lines leading respectively to the jets and rinse piping of a pressure flush toilet is controlled by a control valve which is responsive to variations of water pressure in said first chamber, alternately to direct discharge from the chamber into the respective lines one at a time.

Figure 4:
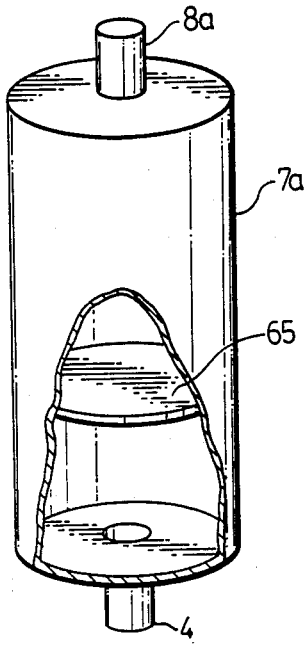
Figure 5:
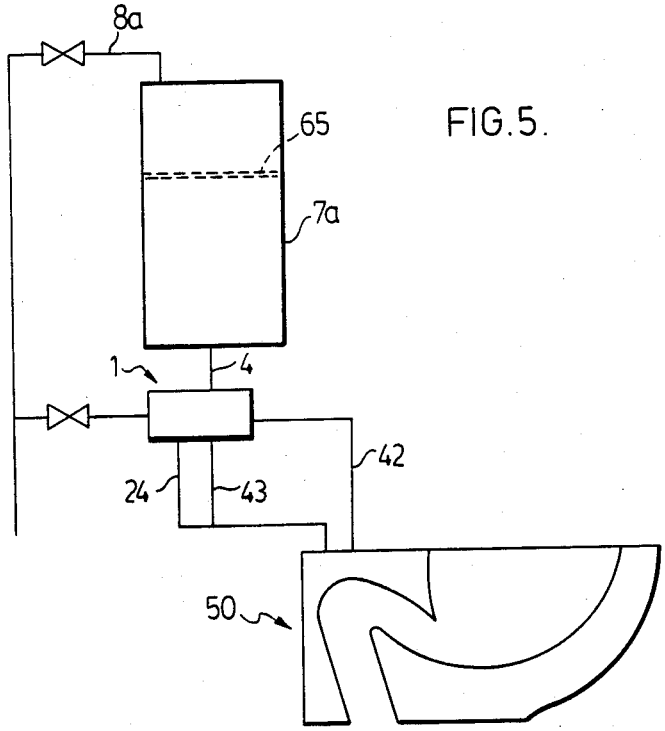
Figure 6:
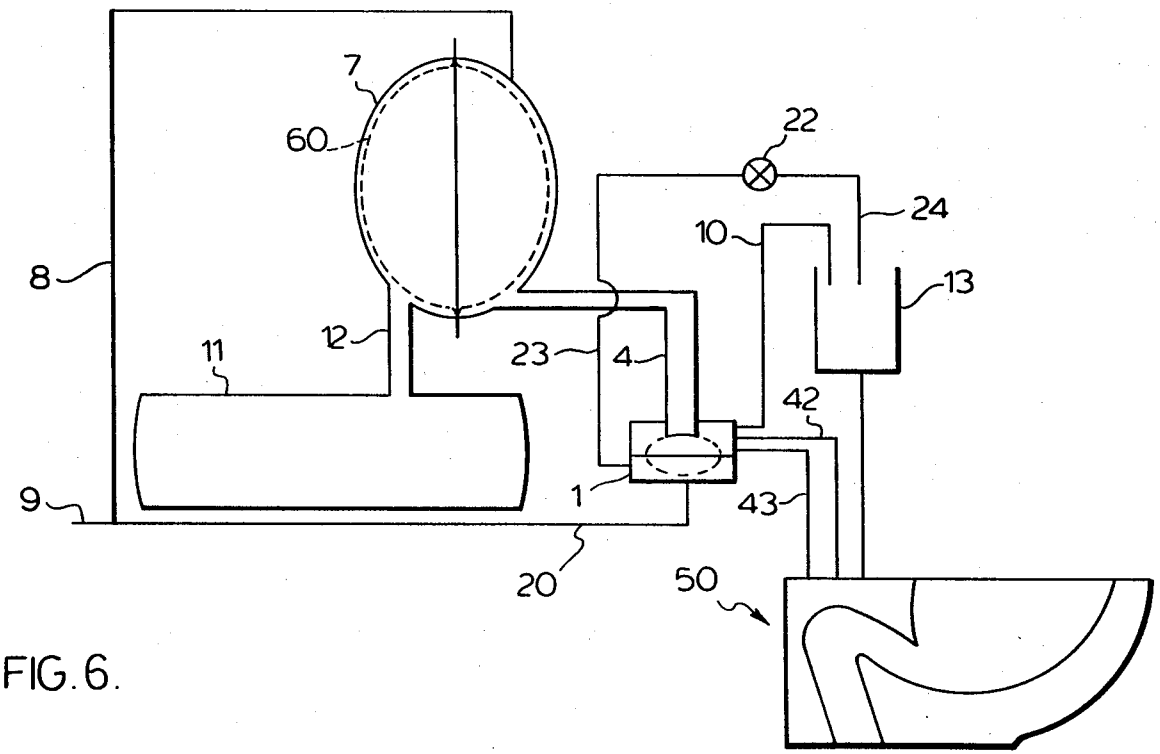

The invention will now be further described with reference to drawings illustrating preferred embodiments of the invention, in which:

FIG. 1 is a cross-sectional elevation of a flush valve according to a preferred embodiment of the invention, FIG. 2 is a schematic view of one embodiment of piping that may be used in conjunction with a toilet and with the valve of FIG. 1, FIG. 3 is a partial sectional view of one embodiment of a pressure tank according to the invention, FIG. 4 is a partial sectional view of a second embodiment of a pressure tank according to the invention, FIG. 5 is a schematic view of an alternative embodiment of piping that may be used with the valve of FIG. 1, and FIG. 6 is another schematic view of variations of the hydraulic flushing assembly of the invention utilizing the valve of FIG. 1.

Referring now to FIG. 1, the diaphragm valve shown generally at 1 has an upper body portion 2 and a lower body portion 3, which can be conveniently moulded from rigid plastics materials, although they can be made from any other suitable material. Upper body portion 2 can be conveniently fastened to lower body portion 3 by screws or other fastening means (not shown). Discharge pipe 4 from an adjacent pressure tank 7 is fixed in upper body portion 2 of valve body 1 and has a flat orifice 5 protruding into the interior of upper body portion 2. Flush diaphragm 16 is substantially larger in area than orifice 5 and is sealingly fastened in seam 6 joining upper and lower valve body portions 2 and 3. Flush diaphragm 16 is made from material capable of sealing against water flow through orifice 5. For example, thin metal can be used where orifice 5 includes a suitable gasket. Preferably, flush diaphragm 16 is made from flexible material sufficiently strong to withstand water pressure to which it is subjected, for example, rubber or resin coated fabric. Lower body portion 3 contains a pilot water tube 20, which is connected to the mains by piping 9. Main water supply pipe 8 feeds adjacent pressure tank 7 from piping 9. Aperture 21 permits flow of water into pressure chamber 17 where, in the pre-flush condition, the pressure is at mains pressure. Chamber 17 also connects with flush release valve 22 by means of flush release pipe 23. Water flowing through valve 22 discharges through tube 24 into the rinse piping of the toilet. Valve 22 is conveniently a spring-loaded ball valve biased to the closed position, although it can be any suitable form of normally-closed valve.

In the pre-flush condition the pressure on diaphragm 16 in the area bounded by pressure tank orifice 5 is the same on both sides. The portion of the upper surface of diaphragm 16 that is outside the are of orifice 5 is subject to atmospheric pressure because of the action of upper body portion elements that will be described below. On the lower surface, however, mains pressure is applied across the entire area of diaphragm 16; this pressure retains diaphragm 16 in sealing relationship with orifice 5 and prevents flow of water out of tank 7.

When it is desired to flush the toilet, flush release valve 22 is opened, lowering the pressure on the lower surface of flush diaphragm 16. The pressure on the upper surface of flush diaphragm 16 bounded by orifice 5 now exceeds the pressure on the lower surface and diaphragm 16 moves to an open position shown approximately by broken line 18. Water thus flows from pressure tank 7 into flush pressure chamber 25, where it impinges on rinse diaphragm 26. Rinse diaphragm 26 sealingly is secured between upper body portion 2 and rinse body portion 30 by screws 31 or other convenient fasteners. Because rinse diaphragm 26 is not required to seal an orifice directly but merely to move rinse control valve 40, rinse diaphragm 26 can conveniently be made from any suitable flexible material having the required strength and flexibility. Preferably, rinse diaphragm 26 is made from rubber or resin-coated fabric, Rigidly fixed to rinse body portion 30 is adjustment cylinder 32, to which is fitted adjustment cap 33 on adjustment threads 34. Rinse control piston 35 slides inside adjustment cylinder 32 and is fastened at its lower end to the centre of rinse diaphragm 26 and to the upper end of rinse control valve 40, which will be described in detail below. In the pre-flush condition, spring 36 between adjustment cap 33 and rinse control piston 35 biases rinse control piston 35 and rinse diaphragm 26 to retain rinse valve 40 in a position that allows communication between flush pressure chamber 25 and rinse line 42 through rinse control orifice 41.

Aperture 21 is sized to allow pressure chamber 17 to refill in about the same time as is necessary to complete the flushing and rinsing of the toilet bowl. In other words, the aperture is constricted, and serves as a constriction to control the flow rate of water refilling chamber 17 to one that permits substantially complete discharge of the volume of flush water from pressure tank 7 through orifice 5. When pressure chamber 17 has refilled, the flush cycle is complete and refilling of the tank 7 is initiated. Preferrably aperature 21 is sized such that flush diaphragm 16 remains seated in the open position 18 until the pressure is low in chamber 25. When the air and water pressure in tank 7 equals the mains pressure, the toilet has achieved the pre-flush condition.

During the flush cycle, as described above, water pressure in flush pressure chamber 25 impinges on rinse diaphragm 26 and raises it to the open position shown approximately by broken line 27. Thus rinse valve 40 is moved to a position which opens communication between flush pressure chamber 25 and bowl flush line 43, allowing water to flow and flush the bowl. As the flush cycle reaches its end, pressure in pressure tank 7 is reduced to the point where rinse diaphragm 26 lowers and stops flow in bowl flush line 43 and permits flow through rinse line 42 to complete the rinsing of the bowl and to provide sufficient water to fill trap 53 (FIG. 2).

Referring now to FIG. 2, the valve assembly of FIG. 1 is shown in conjunction with a toilet adapted to function with the invention. A toilet shown generally at 50 is provided with trap 53 which is a configuration to provide a low water level 55 in bowl 56. Trap 53 leads to sewage outlet pipe 54 which is connected to the sewage system in a conventional manner. When the toilet system is initially charged from the dry state, water flows through mains piping 9 and main water supply pipe 8 into pressure tank 7. Main water supply pipe 8 and pilot water tube 20 include anti-backflow valves 46 and 47 respectively. When air pressure in pressure tank 7 equalizes with pressure in main water supply pipe 8, water flow stops. The system is now in condition for flushing. As described with reference to FIG. 1, as the flush cycle begins, water flows through tube 24 to lower pressure in pressure chamber 17 (FIG. 1) to a value permitting water flow from pressure tank 7 through discharge pipe 4 and bowl flush line 43, to which are connected jets 51. Tube 24 is shown discharging into the flush line 43. However, it can alternatively discharge directly into the top of bowl 56 or, perferably, it can discharge into rinse line 42 or to a surge reservoir described later herein. The pressure forcing water through jets 51 induces rapid displacement of water in the bowl 56 without need for any siphon action in the trap 53. Rinse line 42 is connected to rinse tubes 52 and when water flow through rinse line 42 commences as described earlier, rinse water is dispensed into bowl 56 through orifices (not shown) in rinse tubes 52.

In FIG. 3, one preferred embodiment of pressure tank 7 is shown in partial section. It will be remembered that water flow into pressure tank 7 is arrested when air pressure in pressure tank 7 equals water pressure in main water supply pipe 8. Centrally located pressure diagram 60 in this embodiment separates air above or on one side of the diaphragm from water below or on the other side of the diaphragm, thus dividing the tank into two compartments and preventing both entrainment of air in water during the flush cycle into discharge pipe 4 and absorption of air by the water during the quiescent period between flushes. It should be noted that the air and water sections of tank 7 can be separated by having diaphragm 60 in a generally horizontal plane as shown or in a generally vertical plane for example if cylindrical tank 7 is disposed horizontally.

FIG. 4, illustrating an alternative and more rudimentary arrangement of a pressure tank, *7a*, shows a floating wafer 65 of diameter slightly less than the diameter of the pressure tank *7a*. Water entering pressure tank *7a* from main water supply pipe *8a* flows onto the top of floating wafer 65. Floating wafer 65 remains at the interface between air and water in pressure tank *7a*, and because of the clearance around floating wafer 65, water moves around the edges of floating wafer 65 to bring it back into position at the interface of air and water. When the flush cycle is in operation, floating wafer 65 prevents entrainment of air into water during the flush cycle, and consequent loss of air from pressure tank *7a*. Wafer 65, being of slightly smaller diameter than the inside diameter of pressure tank *7a*, limits the air/water interface and prevents loss of air by its dissolution into water held in tank under pressure.

In FIG. 5 is shown a piping system adapted to function with pressure tank *7a* of FIG. 4. Water having passed into pressure tank *7a* through main water supply pipe *8a* until pressure is equalized as described earlier, valve 1 is activated and water flows through tube 24 to initiate the flush cycle, and then through discharge pipe 4, flush line 43 and rinse line 42 to flush and rinse toilet 50. Disc 65 falls within tank *7a* as the water level falls. At the same time, the air pressure above disc 65 is lowered as the air expands, and the pressure in tank *7a* falls below the main pressure. Water flow through line *8a* begins to refill tank *7a*, and the flow rate reaches a maximum as the water level, and consequently the pressure, reach a minimum. Disc 65, meanwhile, has fallen with the orginal water level and has prevented the entrainment of any substantial quantity of air by covering any vortex in the water as it drains through discharge pipe 4. Flush valve 1 now closes as described above with reference to FIG. 1, and tank *7a* refills. Wafer or disc 65 floats up through the water to reach the water-/air interface, the flow through line *8a* stops as the pressure in tank *7a* reaches the mains pressure, and the system is again ready for flushing.

Referring to FIG. 1, safety tube 10 optionally drains into the upper portion of the toilet bowl or preferably into a surge resevoir described later, but in any event so that the outlet of safety tube 10 is not covered by water at any time in the flush cycle. Safety tube 10 protects against the possibility of waste material from the toilet bowl reaching the water mains through piping 9. In the emergency condition in which pressure is lost in the water mains and simultaneously there is no anti-backflow valve or a defective one, water or air from pressure tank 7 flows back into the supply. At the same time, pressure is lower in pressure chamber 17. Thus pressure on diaphragm 16 becomes insufficient to seal orifice 5 and consequently water drains from tank 7. Waste which could otherwise travel up flush line 43 and into piping 9 by siphon action is prevented from so doing because safety tube 10 is open to the atmosphere, thus precluding any siphoning, and flush pressure chamber 25 drains into the bowl through rinse line 42 and/or safety tube 10. This safety effect occurs with both designs of pressure tank 7 and *7a* (FIGS. 3 and 4).

Further, if the tank *7a* should leak and all air be expelled during a long period when the toilet is not flushed, such that the tank becomes filled with water and no air expansion is available to maintain the flushing action, safety tube 10 will allow the tank to be refilled with air in the following manner. When valve 22 is released to flush the toilet, diaphragm 16 will open orifice 5 and allow water to pass into the toilet through flush line 43 and/or rinse line 42. Not being air-driven, the flow will be slow. When valve 22 is deliberately maintained in the open condition, the tank will empty as air bubbles through safety tube 10 into flush pressure chamber 25 and into tank *7a*. Thus tank *7a* becomes completely empty of water and filled with air at atmospheric pressure, ready to be repressured into the preflush condition by the infux of water after valve 22 is again closed.

In a more sophisiticated embodiment of pressure tank 7 than shown in FIG. 3, the upper part of the tank, above the flexible diaphragm 60, is equipped with a pressurizing air inlet valve (not shown). This valve is used for the introduction of air or other inert gas to establish in the upper part of tank 7 an initial gas pressure which can be any selected pressure above atmospheric which is effectively below the pressure in the water mains. In the initial start-up, the tank 7 is pressurized with air in the upper portion thereof while the lower portion is free of water and contains only air at atmospheric pressure. The gas pressure causes the diaphragm 60 to bulge into the tank space thereafter occupied by water when the lower part of the tank is subsequently charged with water at mains pressure through line 8. When this system then is initially charged with water from the dry state, water flows into tank 7 below the diaphragm and compresses the diaphragm towards the top of tank 7 until the air pressure above the diaphragm is raised by compression to a value equalling the water mains pressure. When this value is reached, further influx of water to the tank is precluded as before until water is discharged through discharge pipe 4 by opening of orifice 5 during a flush cycle. The closer the selected pressure above atmospheric is to the water mains pressure, when the upper part of the tank is initially pressurized with air, the smaller will be the proportion of the tank volume occupied by water flowing into the tank from the mains at the end of a flush cycle, and consequently the smaller will be the volume of water discharged to the toilet bowl during the entire flush cycle.

The foregoing arrangement thus provides a method or means for varying the volume of water used during a flush cycle, simply by adjusting the initial pressure of gas in the gas portion of pressure tank 7 while the other portion of the tank is at atmospheric pressure. Water mains pressure usually is around 300 KPa or about 45 p.s.i.g. A selected pressure for the air in tank 7 when no water is present in the tank can conveniently be, for example, 100 KPa or about 15 p.s.i.g. When the tank then is opened to the mains, the air pressure in the tank rises to the mains pressure, about 300 KPa or 45 p.s.i.g., by influx of water and consequent displacement of pressure diaphragm 60 and compression of the air. When the flush cycle starts, the combination of water and air pressure in the tank ensures that the pressure in tank 7, although dropping much below the mains pressure, doesn't fall below the selected pressure, eg. 100 KPa or about 15 p.s.i.g. If a higher selected pressure is used to charge the tank 7 initially with gas, the volume of water flowing into the tank to refill it in each flush cycle will be smaller, thus reducing the quantity of water used in each flush cycle, as previously noted.

In a variation of the embodiment described immediately above, the pressure tank 7, conveniently formed from two spherical halves, has a diaphragm 60, centrally located and which is adapted to oscillate completely from one extreme end or side of the tank to the other as shown in FIG. 6, permitting the tank to be filled completely, either by air on one side of the diaphragm or water on the other side. To provide air pressure to expel water from the tank for a flush cycle, a separate reservoir of air 11, at appropriate pressure, is connected to the tank on the air side of the diaphragm by an appropriate conduit or compressed air tubing 12. With such an arrangement, the volume of water used in a single flush cycle is substantially just the volume of the pressure tank 7, regardless of the difference in pressure between the water mains and the air reservoir, it still being required of course that the air pressure selected for the reservoir be above atmospheric but effectively below the pressure in the water mains. The volume of the tank can range for example from one to several quarts or liters. The size of the reservoir for air should be sufficiently large that expansion of the air from the reservoir and connecting conduit into the tank still maintains the pressure of the air effectively above atmospheric pressure, so that all water is expelled from the tank by the diaphragm during each flush cycle. This is readily achieved with an air reservoir having a volume of at least two and one half to three times the volume of the tank. It should be noted, however, that this volume can be larger and remote from the tank and the toilet it serves, being connected thereto by an appropriate conduit. Thus any architectural enclosure for the tank and flushing mechanism can be relatively small with the air reservoir located at a remote point therefrom. Furthermore, the reservoir of air can be connected by appropriate conduits to multiple like tanks and by its appropriate volume and pressure, simultaneously serve several such toilet tanks in a house or building, even when more than one of them is flushed at the same time. This is of particular advantage for commercial and institutional installations where several or even many toilets and urinals (a type of toilet) are located in close proximity or at least in one building. A single, conveniently located air pressure reservoir, connected to each flush mechanism by appropriate conduits or compressed air tubing, can serve to operate the flush cycles of all the flush mechanisms in the building. The diaphragm 60 in the tank should be sufficiently strong that it effectively covers the air conduit into the tank without bulging into the latter when the tank is water filled at full mains pressure.

Still another variation of the hydraulic flushing assembly of the invention is illustrated in FIG. 6 and has been referred to earlier in the specification. In this variation, a surge reservoir 13, open to atmospheric pressure, is located at an elevation above the highest water level in a toilet bowl, i.e. above the rim of the bowl. Into this reservoir, water discharged through flush release valve 22 can be directed, as can any water discharging through safely tube 10. From surge reservoir 13, water can drain by gravity to rinse lines into the toilet bowl or directly into the bowl. The primary purpose of the surge reservoir is to provide an atmospheric line through safety tube 10 into the flush pressure chamber 25 (FIG. 1) to prevent siphoning of water from a bowl through the diaphragm valve and pressure tank, in the event of an emergency loss of pressure or a temporary vacuum in the water mains.

The present flush assembly permits the discharge of the flush water under pressure in order to drive a bowl flush, using a minimum number of moving parts. Further, it permits the discharge of a controlled amount of rinse water and bowl refill water, thus ensuring suitable emptying, rinsing and refilling of the toilet bowl while using a minimum of water for the entire cycle. Indeed, prototype units according to the invention have demonstrated excellent flushing performance using less than six liters of water per cycle, a sharp contrast to the 20 to 25 liters used conventionally by other flushing arrangements.

What is claimed is:

1. A diaphragm valve for an hydraulic flushing mechanism, said valve comprising:

(1) a first body portion, fastened to (2) a second body portion, (3) a flexible diaphragm between the body portions which also separates, into two separate chambers, an enclosure formed by the two body portions, (4) a discharge orifice from an adjacent tank of water maintained under pressure, said orifice protruding into the first of said chambers through said first body portion, having a discharge area smaller than the area of the first side of said diaphragm, and being adapted to be sealed by the diaphragm in a sealing position, (5) inlet means through the second body portion, connected to a water supply at water main pressure, to supply water to the second of said chambers through a constricted aperture, the diaphragm being adapted to maintain its sealing position by water at water main pressure on the second side of the diaphragm in the second chamber, (6) a release valve adapted to release water pressure in the second chamber and discharge same to atmospheric pressure through a discharge line, and (7) at least two outlets from said first chamber to discharge water from the chamber, one of said outlets being adapted to communicate directly to a pressure flush toilet facility and another to an atmospheric pressure discharge.

2. A diaphragm valve as claimed in claim 1 having three outlets from said first chamber, the first of said outlets being open continuously to discharge at atmospheric pressure, the second and third of said outlets being adapted to discharge respectively through pressure flush and rinse lines of a pressure flush toilet.

3. A diaphragm valve as claimed in claim 2 and further including a control valve, responsive to variations in water pressure in the first chamber, to direct discharge into only one at a time of said pressure flush and rinse lines.

4. An hydraulic flushing assembly comprising:

(1) a tank adapted to receive and maintain a quantity of water under pressure, (2) a water supply at mains pressure to said tank, (3) an outlet conduit from said tank terminating in a discharge orifice, (4) a diaphragm valve for an hydraulic flushing mechanism, as defined in claim 1, mounted on said discharge orifice, (5) a first discharge line communicating between one outlet from the first chamber of said diaphragm valve and the jets of a pressure flush toilet facility, (6) a second discharge line communicating between a second outlet from said from said first chamber and the rinse piping of said toilet, (7) a third discharge line communicating between a third outlet from said first chamber and a discharge point open to the atmosphere and above the highest water level in the toilet facility.

5. An hydraulic flushing assembly as claimed in claim 4 in which to maintain said tank under pressure, it is interiorly divided into two compartments by a centrally located pressure diaphragm therein, separating water on one side of the diaphragm from pressured air on the other side at pressure less than the water mains pressure.

6. An hydraulic flushing assembly as claimed in claim 5 and further including a pressurizing air inlet valve on said tank adapted to release and introduce pressured air in the air compartment.

7. An hydraulic flushing assembly as claimed in claim 5, and which the pressure diaphragm is adapted to oscillate within the tank to permit the tank to be filled completely by water on one side of the diaphragm or by pressured air on the other side of the diaphragm, and further including a separate reservoir of air under pressure and connected to the tank on the air side of the diaphragm by a conduit.

8. An hydraulic flushing assembly as claimed in claim 7 and including multiple like assemblies with the pressure tank of each assembly being connected by conduit to a single reservoir of air under pressure.

9. An hydraulic flushing assembly as claimed in claim 4 and further including a surge reservoir, open to atmospheric pressure and located at an elevation above the highest water level in the toilet facility, to receive any water discharged from said third discharge line of the diaphragm valve and drain it to the toilet facility.

10. An hydraulic flushing assembly as claimed in claim 9 in which water discharge by the release valve, associated with the diaphragm valve, also is discharged into the surge reservoir.

* * * * *